US009393531B2

(12) United States Patent
Hiemer

(10) Patent No.: US 9,393,531 B2
(45) Date of Patent: Jul. 19, 2016

(54) CONNECTING PIECE FOR A STATIC SPRAY MIXER

(75) Inventor: Andreas Hiemer, Shübelbach (CH)

(73) Assignee: SULZER MIXPAC AG, Haag (CH)

( * ) Notice: Subject to any disclaimer, the term of this patent is extended or adjusted under 35 U.S.C. 154(b) by 472 days.

(21) Appl. No.: 13/477,582

(22) Filed: May 22, 2012

(65) Prior Publication Data

US 2012/0298775 A1 Nov. 29, 2012

(30) Foreign Application Priority Data

May 23, 2011 (EP) ..... 11167132

(51) Int. Cl.

| | |
|---|---|
| ***B01F 5/06*** | (2006.01) |
| ***B05B 7/04*** | (2006.01) |
| ***B05B 7/08*** | (2006.01) |
| ***B05B 7/10*** | (2006.01) |
| ***B05B 15/06*** | (2006.01) |
| *B05B 7/06* | (2006.01) |

(52) U.S. Cl.

CPC ..... *B01F 5/0641* (2013.01); *B05B 7/0408* (2013.01); *B05B 7/0861* (2013.01); *B05B 7/10* (2013.01); *B05B 15/069* (2013.01); *B05B 7/062* (2013.01); *B05B 7/066* (2013.01)

(58) Field of Classification Search

USPC ..... 239/398, 399, 405, 406, 424, 427, 239/427.3, 459, 487, 491, 492, 600, 239/431–434, 311, 428, 8, 280, 280.5, 281; 222/145.5, 145.6, 459

See application file for complete search history.

(56) References Cited

U.S. PATENT DOCUMENTS

| | | | | |
|---|---|---|---|---|
| 2,362,213 | A * | 11/1944 | Miller et al. | 239/406 |
| 2,984,421 | A * | 5/1961 | Hession, Jr. | 239/402.5 |
| 4,546,923 | A * | 10/1985 | Ii | 239/406 |
| 5,397,180 | A | 3/1995 | Miller | |
| 5,413,253 | A | 5/1995 | Simmen | |

(Continued)

FOREIGN PATENT DOCUMENTS

| | | |
|---|---|---|
| CN | 2576236 Y | 10/2003 |
| EP | 0 645 990 B1 | 4/1995 |

(Continued)

OTHER PUBLICATIONS

European search report for corresponding EP11167132.7-2425 issued on Oct. 7, 2011.

(Continued)

*Primary Examiner* — Len Tran
*Assistant Examiner* — Alexander Valvis
(74) *Attorney, Agent, or Firm* — Global IP Counselors, LLP

(57) ABSTRACT

A connecting piece is provided for a static spray mixer for mixing and spraying at least two flowable components which has a tubular mixer housing having at least one mixing element as well as an atomizing sleeve, wherein connecting piece has an inlet region for cooperating with the distal end region of the mixer housing as well as an outlet region for cooperating with the atomizing sleeve, with the inlet region and the outlet region including a deflection angle (α) different from zero, and wherein the outlet region has at its end remote from the inlet region an end section whose outer contour is the same as that of the mixer housing so that the end section of the outlet region can cooperate with the atomizing sleeve in the same manner as the distal end region of the mixer housing can cooperate with the atomizing sleeve.

17 Claims, 6 Drawing Sheets

(56) References Cited

U.S. PATENT DOCUMENTS

| | | | | |
|---|---|---|---|---|
| 5,570,822 | A * | 11/1996 | LeMarbe et al. | 222/459 |
| 5,788,702 | A | 8/1998 | Draenert | |
| 6,247,658 | B1 * | 6/2001 | Bakas | B08B 3/026 134/123 |
| 6,601,782 | B1 * | 8/2003 | Sandholm et al. | 239/427 |
| 6,616,068 | B2 * | 9/2003 | Hunter | 239/398 |
| 6,629,774 | B1 * | 10/2003 | Gruendeman | 366/336 |
| 6,663,021 | B1 * | 12/2003 | Scarpa et al. | 239/424 |
| 6,755,359 | B2 * | 6/2004 | Sprouse et al. | 239/405 |
| 6,951,310 | B2 * | 10/2005 | Anderson | 239/463 |
| 7,503,686 | B2 * | 3/2009 | Tarmann et al. | 366/173.1 |
| 8,534,575 | B2 * | 9/2013 | Brem | 239/422 |
| 2003/0226910 | A1 | 12/2003 | Anderson | |
| 2005/0008474 | A1 | 1/2005 | Stalder | |
| 2005/0023376 | A1 * | 2/2005 | Anderson | 239/432 |
| 2005/0095307 | A1 * | 5/2005 | Bergqvist | 425/4 R |
| 2007/0017938 | A1 | 1/2007 | Thompson et al. | |
| 2011/0273956 | A1 | 11/2011 | Habibi-Naini et al. | |

FOREIGN PATENT DOCUMENTS

| | | | |
|---|---|---|---|
| EP | 0815929 | A1 | 1/1998 |
| EP | 2 230 025 | A1 | 9/2010 |
| RU | 2091146 | C1 | 9/1997 |
| SU | 1162469 | A | 6/1985 |
| TW | I325791 | B | 6/2010 |
| WO | 2004105856 | A1 | 12/2004 |
| WO | 2012-010337 | A1 | 1/2012 |
| WO | 2012-010338 | A1 | 1/2012 |

OTHER PUBLICATIONS

Taiwanese Search Report issued Dec. 18, 2015 in TW Application No. 101117810.

* cited by examiner

Prior Art

CONNECTING PIECE FOR A STATIC SPRAY MIXER

PRIORITY CLAIM

The present application claims priority to European Patent Application No. 11167132.7 filed on May 23, 2011, the disclosure of which is incorporated herein by reference.

BACKGROUND

The present application relates to a connecting piece for a static spray mixer for the mixing and spraying of at least two flowable components in accordance with an embodiment. The present application further relates to the combination of such a connecting piece with a static spray mixer according to an embodiment.

Static mixers for the mixing of at least two flowable components are described, for example, in EP-A-0 749 776 and in EP-A-0 815 929. These very compact mixers provide good mixing results, in particular also for the mixing of high-viscosity materials such as sealing compounds, two-component foams or two-component adhesives, despite a simple, material-saving design of their mixer structure. Such static mixers are usually designed for single use and are frequently used for products which harden such that the mixers can practically no longer be cleaned.

In some applications in which such static mixers are used, it is desirable to spray the two components onto a substrate after their mixing in the static mixer. For this purpose, the mixed components are atomized at the outlet of the mixer by the action of a medium such as air and can then be applied to the desired substrate in the form of a spray jet or spray mist. In particular more highly viscous coating media, e.g. polyurethanes, epoxy resins or similar, can also be processed using this technology.

An apparatus for such applications is disclosed, for example, in U.S. Pat. No. 6,951,310. In this apparatus, a tubular mixer housing is provided which receives the mixing element for the static mixer and which has an external thread at one end onto which a ring-shaped nozzle body is screwed. The nozzle body likewise has an external thread. A conical atomizer element which has a plurality of grooves extending in the longitudinal direction on its cone surface is placed onto the end of the mixing element which projects out of the mixer housing. A cap is pushed over this atomizer element and its inner surface is likewise of conical design so that it contacts the conical surface of the atomizer element. The grooves consequently form flow passages between the atomizer element and the cap. The cap is fixed to the nozzle body together with the atomizer element by means of a retaining nut which is screwed onto the external thread of the nozzle body. The nozzle body has a connection for compressed air. In operation, the compressed air flows out of the nozzle body through the flow passages between the atomizer element and the cap and atomizes the material being discharged from the mixing element.

Even if this apparatus has absolutely proved to be fully functional, its structure is very complex and the installation is complicated and/or expensive so that the apparatus is in particular not very cost-effective with respect to the single use.

Static spray mixers of a much simpler construction are disclosed in the international patent applications PCT/EP2011/057378 and PCT/EP2011/057379 of Sulzer Mixpac AG. In this spray mixer, the mixer housing and the atomizing nozzle are each made in one piece, with the grooves forming the flow passages being provided in the inner surface of the atomizing nozzle or in the outer surface of the mixer housing.

SUMMARY

The present application is directed to make such spray mixers for mixing and spraying at least two flowable components accessible for an even larger field of application, with a handling being ensured which is as simple as possible according to an embodiment.

In accordance with the an embodiment, a connecting piece is therefore proposed for a static spray mixer for mixing and spraying at least two flowable components which has a tubular mixer housing having at least one mixing element as well as an atomizing sleeve, wherein the mixer housing extends in the direction of a longitudinal axis up to a distal end which has an outlet opening for the components, and wherein the atomizing sleeve has an inlet passage for a pressurized atomizing medium as well as an inner surface having a plurality of grooves which can form separate flow passages together with the mixer housing, which connecting piece has an inlet region for cooperating with the distal end region of the mixer housing as well as an outlet region for cooperating with the atomizing sleeve, with the inlet region and the outlet region including a deflection angle different from zero, and wherein the outlet region has at its end remote from the inlet region an end section whose outer contour is the same as that of the mixer housing so that the end section of the outlet region can cooperate with the atomizing sleeve in the same manner as the distal end region of the mixer housing can cooperate with the atomizing sleeve.

The connecting piece makes it possible in a simple manner also to use a static spray mixer in such application cases in which the surface to be sprayed is more difficult to access. It is thus possible with this connecting piece to squirt or spray around corners, for example. This opens up an even wider field of use of such static spray mixers. Since the end section of the outlet region of the connecting piece has the same design with respect to its outer contour as the distal end region of the mixer housing, this end section of the outlet region can cooperate just as easily with the atomizing sleeve as the mixer housing, that is the connecting piece makes possible an equally good homogenous atomizing and a stable flow of the fluid at the outlet of the connecting piece where the mixed components emerge.

It is preferred due to practical experience that the deflection angle between the inlet region and the outlet region is in the range from 45 to 135 degrees, preferably in the range from 60 to 120 degrees, according to an embodiment.

In a preferred embodiment, the deflection angle between the inlet region and the outlet region amounts to 90 degrees, for this geometry has proven advantageous for many application cases.

The inner contour of the inlet region of the connecting piece is preferably dimensioned so that it can areally contact the distal end region of the mixer housing according to an embodiment. A secure guidance of the connecting piece is ensured by this measure and leaks between the outlet opening of the mixer housing and the connecting piece can be avoided according to an embodiment.

Since it is particularly simple from a construction and handling aspect, it is preferred if the inlet region can be connected to the mixer housing without a thread, for example by means of a snap-in connection according to an embodiment.

It is preferred for the same reason if the outlet region can be connected to the atomizing sleeve without a thread, for example by means of a snap-in connection according to an embodiment.

A further advantageous measure is that the outlet region has at its end facing the inlet region an end plate which is designed for engaging into the atomizing sleeve so that an emergence of the atomizing medium during operation is prevented by the end plate according to an embodiment. This end plate can be used to connect the connecting piece to the atomizing sleeve by the engagement into the atomizing sleeve according to an embodiment.

The outlet region preferably includes a passage for the mixed components which has a substantially constant inner diameter according to an embodiment. It can namely be realized by this measure that the outlet at the end of the connecting piece is a copy of the outlet opening at the mixer housing so that the same flow relationships are present for the mixed components at the outlet as at the outlet opening according to an embodiment.

It has furthermore proved advantageous if at least one guide element is provided between the end plate and the end section of the outlet region, with the outer diameter of said one guide element being modeled on the outer contour of the distal end region of the mixer housing according to an embodiment. It can hereby be realized that the flow relationships for the atomizing medium introduced under pressure at the end of the connecting piece are comparable or the same as those such as would be present without the connecting piece at the outlet opening of the mixer housing in an embodiment.

In an embodiment, a plurality of respective disk-shaped guide elements are provided arranged behind one another for this purpose and their outer diameter is modeled on the outer diameter of the mixer housing. That is, a disk-shaped guide element which is a specific distance away from the outlet of the connecting piece has substantially the same outer diameter as the mixer housing at that point which is located at the same distance from the outlet opening of the mixer housing.

In accordance with another embodiment, a guide element shaped as a helical line is provided whose outer diameter is modeled on the outer diameter of the mixer housing.

The combination of a static spray mixer for mixing and spraying at least two flowable components with a connecting piece in accordance with an embodiment is furthermore provided, wherein the static spray mixer has a tubular mixer housing having at least one mixing element as well as an atomizing sleeve, wherein the mixer housing extends in the direction of a longitudinal axis up to a distal end which has an outlet opening for the components, and wherein the atomizing sleeve has an inlet passage for a pressurized atomizing medium as well as an inner surface having a plurality of separate grooves which can form separate flow passages together with the mixer housing.

A preferred combination in an embodiment is that the atomizing sleeve can be connected to the connecting piece such that the atomizing sleeve can be rotated around the connecting piece. The supply of the atomizing medium can be designed substantially more flexibly by this measure.

In another embodiment the combination is provided so that the connecting piece is shaped to the mixer housing so that the connecting piece is in one piece with the mixer housing.

Additional features and advantages are described herein, and will be apparent from the following Detailed Description and the figures.

DETAILED DESCRIPTION

The present application will be described below in greater detail with reference to the figures according to an embodiment.

Figure 1:
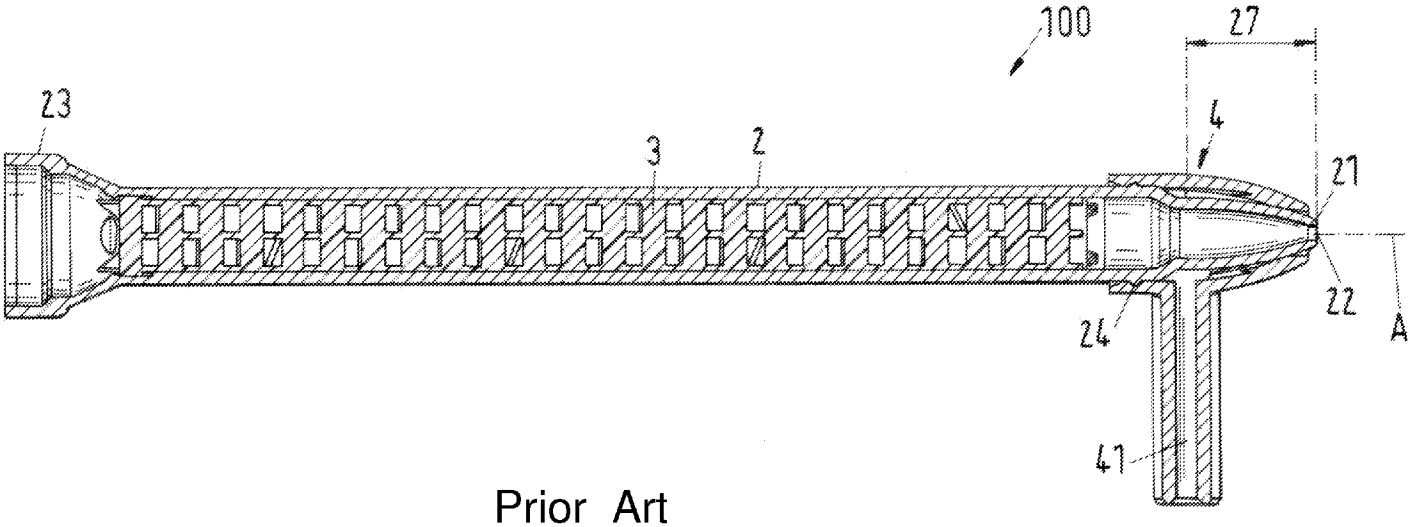
Fig.1 Prior Art
FIG. 1 is a longitudinal section of an embodiment of a static spray mixer.
Figure 2:
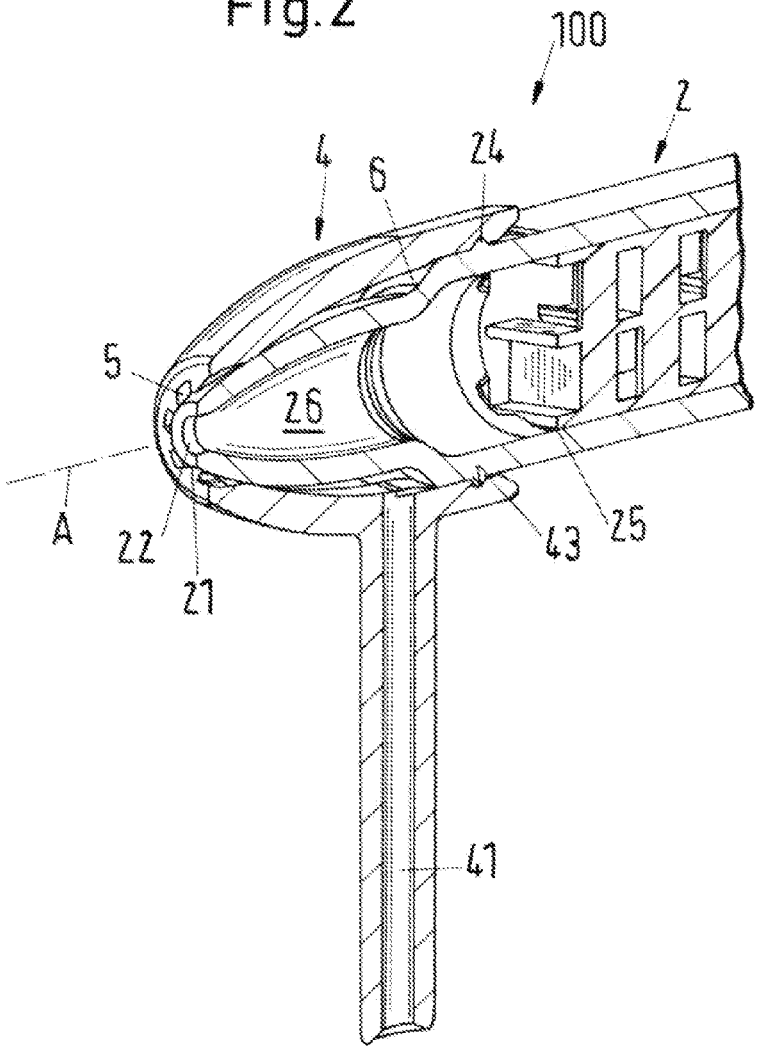
FIG. 2 is a perspective sectional representation of the distal end region of the static spray mixer of FIG. 1.

A static spray mixer will first be explained with reference to FIG. 1 and FIG. 2 such as is disclosed, for example, in the European patent application No. 1070141.5 of Sulzer Mixpac AG. FIG. 1 shows a longitudinal section of an embodiment of a static spray mixer which is designated as a whole by the reference numeral 100. The spray mixer 100 serves for mixing and spraying at least two flowable components. FIG. 2 shows a perspective sectional representation of the distal end region of the static spray mixer 100. Reference is made to the two already quoted international patent applications Nos. PCT/EP2011/057378 and PCT/EP2011/057379 of Sulzer Mixpac AG with respect to a more detailed explanation of the static spray mixer 100

Reference is made in the following to the case particularly relevant to practice that precisely two components are mixed and sprayed. It is, however, understood that the present application can also be used for the mixing and spraying of more than two components.

The spray mixer 100 includes a tubular, one-piece mixer housing 2 which extends in the direction of a longitudinal axis A up to a distal end 21. In this respect, that end is meant by the distal end 21 at which the mixed components exit the mixer housing 2 in the operating state. The distal end 21 is provided with an outlet opening 22 for this purpose. The mixer housing 2 has a connecting piece 23 at the proximal end, which means that end at which the components to be mixed are introduced into the mixer housing 2, and the mixer housing 2 can be connected to a storage container for the components by means of said connecting piece. This storage container can, for example, be a two-component cartridge known per se, can be designed as a coaxial cartridge or a side-by-side cartridge or can be two tanks in which the two components are stored separately from one another. The connecting piece is designed, depending on the design of the storage container or of its outlet, e.g. as a snap-in connection, as a bayonet connection, as a threaded connection or combinations thereof.

At least one static mixing element 3 is arranged in a manner known per se in the mixer housing 2 and contacts the inner wall of the mixer housing 2 so that the two components can only move from the proximal end to the outlet opening 22 through the mixing element 3. Either a plurality of mixing elements 3 arranged behind one another can be provided or, as in the present embodiment, a one-piece mixing element 3 which is preferably injection molded and is made of a thermoplastic. Such static mixers or mixing elements 3 are sufficiently known per se to the skilled person and do not therefore require any further explanation.

Such mixers or mixing elements 3 are in particular suited such as are sold under the brand name QUADRO® by the company Sulzer Chemtech AG (Switzerland). Such mixing elements are described, for example, in the already cited documents EP-A-0 749 776 and EP-A-0 815 929. Such a mixing element 3 of the Quadro® type has a rectangular cross-section, in particular a square cross-section, perpendicular to the longitudinal direction A. Accordingly, the one-piece mixer housing 2 also has a substantially rectangular, in particular square, cross-sectional surface perpendicular to the longitudinal axis A, at least in the region in which it surrounds the mixing element 3.

The mixing element 3 does not extend fully up to the distal end 21 of the mixer housing 2, but rather ends at an abutment 25 (see FIG. 2) which is here realized by the transition of the mixer housing 2 from a square cross-section to a round cross-section. Viewed in the direction of flow, the inner space of the mixture housing 2 therefore has a substantially square cross-section for the reception of the mixing element 3 up to this abutment 25. At this abutment 25, the inner space of the mixer housing 2 merges into a circular conical shape which realizes a tapering in the mixer housing 2. Here, the inner space therefore has a circular cross-section and forms a starting region 26 which tapers in the direction of the distal end 21 and opens into the outlet opening 22 there.

The static spray mixer 1 furthermore has an atomizing sleeve 4 which has an inner surface which surrounds the mixer housing 2 in its end region. The atomizing sleeve 4 is designed in one piece and is preferably injection molded, in particular from a thermoplastic. It has an inlet passage 41 for a pressurized atomizing medium which is in particular gaseous. The atomizing medium is preferably compressed air. The inlet passage 41 can be designed for all known connections, in particular also for a Luer lock.

To enable a particularly simple installation or manufacture, the atomizing sleeve 4 is preferably connected to the mixer housing in a thread-free manner, in the present embodiment by means of a snap-in connection. For this purpose, a flange-like elevated portion 24 is provided at the mixer housing 2 (see FIG. 2) and extends over the total periphery of the mixer housing 2. A peripheral groove 43 is provided at the inner surface of the atomizing sleeve 4 and is designed for cooperation with the elevated portion 24. If the atomizing sleeve 4 is pushed over the mixer housing 2, the elevated portion 24 snaps into the peripheral groove 43 and provides a stable connection of the atomizing sleeve 4 to the mixer housing 2. This snap-in connection is preferably designed in a sealing manner so that the atomizing medium—here the compressed air—cannot escape through this connection comprising the peripheral groove 43 and the elevated portion 24. The inner surface of the atomizing sleeve 4 furthermore lies tightly on the outer surface of the mixer housing 2 in a region between the opening of the inlet passage 41 and the elevated portion 24 so that a sealing effect is also hereby achieved which prevents a leak or a backflow of the atomizing medium.

It is naturally also possible to arrange additional sealants, for example an O ring, between the mixer housing 2 and the atomizing sleeve 4.

Alternatively to the embodiment shown, it is also possible to provide a peripheral groove at the mixer housing 2 and to provide an elevated portion which engages into this peripheral groove at the atomizing sleeve 4.

A plurality of grooves 5 are provided in the inner surface of the atomizing sleeve 4 which each extend to the distal end 21 and which form separate flow passages between the atomizing sleeve 4 and the mixer housing 2 through which flow passages the atomizing medium can flow from the inlet passage 41 of the atomizing sleeve 4 to the distal end 21 of the mixer housing 2.

The grooves 5 can be designed as curved, for example arcuate, or also as a straight line or also by combinations of curved and straight-line sections. Reference is made to the already quoted international patent applications Nos. PCT/EP2011/057378 and PCT/EP2011/057379 with respect to the specific design possibilities for the grooves 5.

The inner surface of the atomizing sleeve 4 is designed to cooperate with the distal end region 27 of the mixer housing 2. The ribs of the atomizing sleeve 4, provided between the grooves 5, and the outer surface of the mixer housing 2 contact one another in a tight and sealing manner so that the grooves 5 each form a separate flow passage between the inner surface of the atomizing sleeve 4 and the outer surface of the mixer housing 2.

Further upstream, in the region of the opening of the inlet passage 41 (see also FIG. 2), the height of the ribs between the grooves 5 is so small that a ring space 6 exists between the outer surface of the mixer housing 2 and the inner surface of the atomizing sleeve 4. The ring space 6 is in flow communication with the inlet 41 of the atomizer sleeve 4. The atomizing medium can move out of the inlet passage 41 into the separate flow passages through the ring space 6.

The grooves 5 are distributed uniformly over the inner surface of the atomizing sleeve 4. It has proven to be advantageous with respect to an atomizing which is as complete and as homogeneous as possible of the mixed components exiting the outlet opening if the compressed air flows generated by the grooves 5 have a swirl, that is, a rotation, on a helical line about a longitudinal axis A. This swirl effects a considerable stabilization of the compressed air flow. The circulating atomizing medium, here compressed air, generates a jet which is stabilized by the swirl and thus acts uniformly on the mixed components exiting the outlet opening 22. A very uniform and in particular reproducible spray pattern results from this. A compressed air jet which is as conical as possible and which is stabilized by the swirl is particularly favorable in this respect. A significantly smaller spray loss (overspray) results in the application due to this extremely uniform and reproducible air flow.

The individual compressed air jets (or jets of the atomizing medium) exiting the respective separate flow passages at the distal end 21 are first formed as discrete individual jets on their exit which then combine to form a uniform stable total jet due to their swirl property, said total jet atomizing the mixed components exiting the mixer housing. This total jet preferably has a conical extent.

A plurality of measures are possible to generate the swirl in the flow of the atomizing medium. The grooves 5 which form the flow passages 5 do not extend exactly in the axial direction defined by the longitudinal axis A or do not only extend inclined toward the longitudinal axis, but the extent of the grooves 4-5 also has a component in the peripheral direction of the atomizing sleeve 4. In addition to the inclination with respect to the longitudinal axis A, the extent of the grooves 5 is at least approximately spiral or in the form of a helical line about the longitudinal axis A.

A further measure for generating the swirl is to arrange the inlet passage 41, through which the atomizing medium moves into the flow passages, asymmetrically with respect to the longitudinal axis A. The inlet passage 41 is arranged so that its central axis does not intersect the longitudinal axis A, but rather has a perpendicular spacing from the longitudinal axis A. This asymmetrical or also eccentric arrangement of the inlet passage 41 with respect to the longitudinal axis A has the result that the atomizing medium, that is here the compressed air, is set into a rotational or swirl movement about the longitudinal axis A on entry into the ring space 6.

To increase the energy input from the atomizing medium to the components exiting the outlet opening 22, it is a particularly advantageous measure to configure the flow passages 51 in accordance with the principle of a Laval nozzle having a flow cross-section first narrowing and subsequently flaring, viewed in the direction of flow. To realize this narrowing of the flow cross-section, two dimensions are available, namely the two directions of the plane perpendicular to the longitudinal axis A. It can be seen in FIG. 2, at least for the direction of flow of the compressed air, that the individual flow passages first narrow and then expand again as is typical for a Laval nozzle.

The air used as the atomizing medium can also additionally be acted on by kinetic energy downstream of the narrowest point and can thus be accelerated by the configuration of the grooves 5 or of the flow passages in accordance with the principle of a Laval nozzle. This is done as with a Laval nozzle by the flow cross-section again widening in the direction of flow. A higher energy input into the components to be atomized results from this. In addition, the jet is stabilized by this realization of the Laval principle. The diverging opening, that is the opening which widens again, of the respective flow channel moreover has the positive effect of an avoidance or of at least a considerable reduction of fluctuations in the jet.

In operation, this embodiment works as follows. The static spray mixer is connected by means of its connecting piece 23 to a storage vessel which contains the two components separate from one another, for example with a two-component cartridge. The inlet channel 41 of the atomizing sleeve 4 is connected to a source for the atomizing medium, for example to a compressed air source. The two components are now dispensed, move into the static spray mixer 100 and are there intimately mixed by means of the mixing element 3. After flowing through the mixed element 3, the two components move as a homogeneously mixed material through the outlet region 26 of the mixer housing 2 to the outlet opening 22. The compressed air flows through the inlet channel 41 of the atomizing sleeve 4 into the ring space 6 between the inner surface of the atomizing sleeve 4 and the outer surface of the mixer housing 2, has a swirl imparted onto it in this process by the asymmetrical arrangement and moves from there through the grooves 5 which form the flow passages to the distal end 21 and thus to the outlet opening 22 of the mixer housing 3. The compressed air flow stabilized by the swirl here impacts the mixed material exiting the outlet opening 22, atomizes it uniformly and transports it as a spray jet to the substrate to be treated or to be coated. Since the dispensing of the components from the storage vessel takes place with compressed air or supported by compressed air in some applications, the compressed air can also be used for the atomizing.

Figure 3:
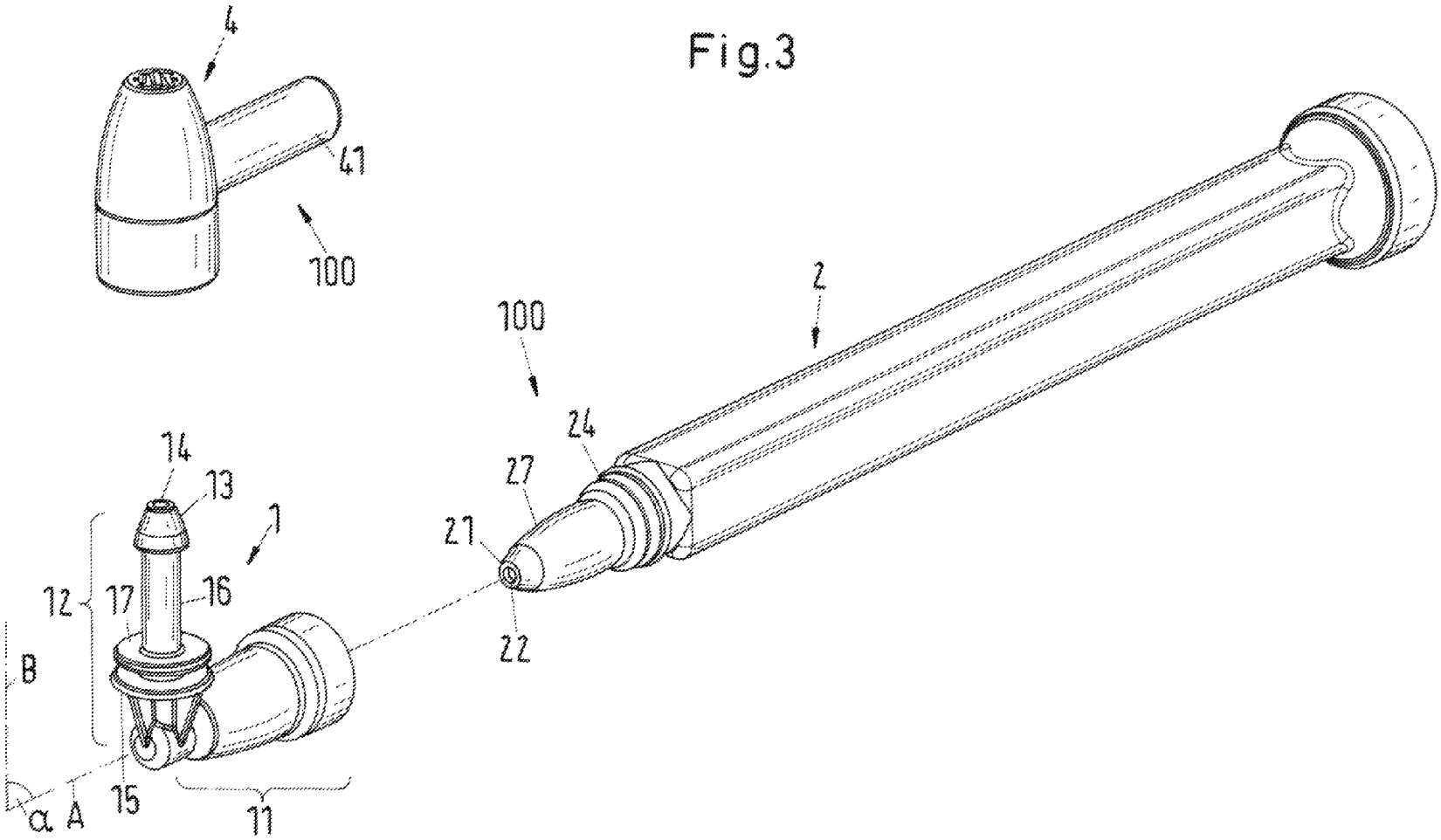
FIG. 3 is a perspective representation of an embodiment of a connecting piece in accordance with the invention together with a static spray mixer in an exploded representation.

A connecting piece is now proposed by the invention which is especially designed to cooperate with such a static spray mixer. FIG. 3 shows a perspective representation of an embodiment of a connecting piece in accordance with the invention, which is designated as a whole by the reference numeral 1, together with the static spray mixer 100 in an exploded representation. The connecting piece 1 is specifically designed to be arranged—in a similar manner to an adapter—between the distal end region of the mixer housing 2 and the atomizing sleeve 4.

The connecting piece 1 includes an inlet region 11 for cooperation with the distal end region 27 of the mixer housing 2 as well as an outlet region 12 for cooperation with the atomizing sleeve 4. The outlet region 12 includes an outlet 14 through which the mixed components can emerge. The inlet region 11 and the outlet region 12 include a deflection angle $\alpha$ different from zero. It is meant by this that the axis in whose direction the inlet region 11 extends (here the longitudinal axis A of the mixer housing) and the axis B in whose direction the outlet region 12 extends, include the deflection angle $\alpha$. The deflection angle $\alpha$ is also different from 180°. The outlet region 12 has at its end remote from the inlet region an end section 13 whose outer contour is equal to that of the mixer housing 2 so that the end section 11 of the outlet region 12 can cooperate with the atomizing sleeve 4 in the same way as the distance end region 27 of the mixer housing 2. All the positive flow-mechanical properties which are realized by the cooperation between the atomizing sleeve 4 and the distal end region 27 are thus maintained in the same quality when the end section 13 of the outlet region 12 of the connecting piece 1 cooperates with the atomizing sleeve 4. In an analog manner as already described above, the separate flow passages through which the atomizing medium moves to the outlet end in the same manner in the form of individual compressed air jets (or jets of the atomizing medium) are formed by the grooves 5 (see FIG. 2) in the inner surface of the atomizing sleeve 4 between the end section 13 of the outlet region 12 and the atomizing sleeve 4. The compressed air jets are there first formed as discrete individual jets on their outlet which then combine due to their swirl load to a uniform, stabile total jet which atomizes the mixed components emerging from the outlet 14. This total jet preferably has a conical extent.

The end section 13 of the outlet region 12 is thus a model of the distal end of the mixer housing 2.

Spraying can also take place in a simple manner at points which are difficult to access due to the deflection angle $\alpha$ different from zero with the aid of the connecting piece. It is preferred under practical aspects if the deflection angle $\alpha$ is in the range from 45° to 135°, in particular in the range from 60° to 120°. In the embodiment described here, the deflection angle $\alpha$ is equal to 90° which is advantageous for many application cases. It is, however, understood that any other deflection angles $\alpha$ are also possible.

Figure 6:
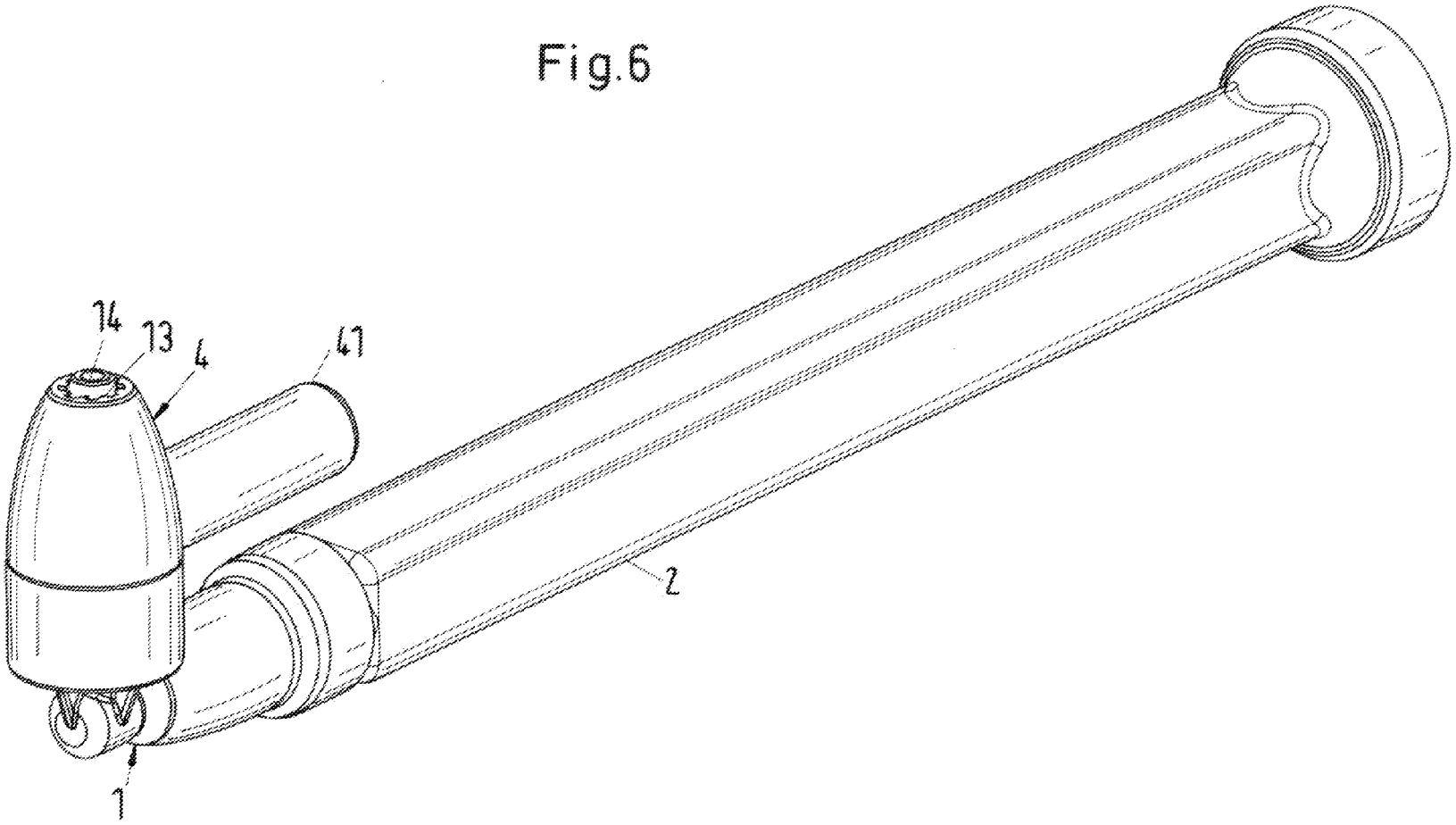
FIG. 6 is a perspective representation of a combination of a static spray mixer with a connecting piece in accordance with the invention in the assembled state.

For operation, the inlet region 11 of the connecting piece 1 is connected to the distal end of the mixer housing 2 and the atomizing sleeve 4 is placed onto the outlet region 12 of the connecting piece 1. FIG. 6 shows an embodiment in the assembled state.

The inner contour of the inlet region 11 of the connecting piece 1 is preferably dimensioned so that the inlet region 11 areally contacts the distal end region 27 of the mixer housing 2. It is hereby ensured that the mixed components emerging from the mixer housing 2 flow completely into the connecting piece and no leaks occur between the mixer housing 2 and the connecting piece 1.

The inlet region 11 is preferably threadlessly connectable to the mixer housing 2 because a particularly simple handling is hereby ensured. The inlet region 11 is particularly preferably connected to the mixer housing via a snap-in connection, in accordingly the same manner as has been described with reference to FIG. 2 for the connection of the atomizing sleeve 4 to the mixer housing 2. For this purpose, a peripheral groove (corresponding to the peripheral groove 43 in FIG. 2) is provided at the inner surface of the inlet region 11 of the connecting piece—in accordingly the same manner as shown in FIG. 2 for the atomizing sleeve 4—said peripheral groove being designed to cooperate with the flange-like elevated portion 24 at the mixer housing 2. If the inlet region 11 is pushed over the mixer housing 2, the elevated portions 24 snaps into the peripheral groove and provides a stable connection of the connecting piece 1 to the mixer housing 2. This snap-in connection is preferably designed in a sealing manner so that a sealing effect is also hereby achieved which prevents a leak or a backflow of the mixed components.

The connection of the connecting piece 1 to the mixer housing 2 via a peripheral groove and the elevated portion 24 engaging therein has the further advantage that the connecting piece 1 is rotatable about the longitudinal axis A with respect to the mixer housing 2, whereby the flexibility is further increased with respect to the applications.

The outlet region 12 of the intermediate piece 1 is preferably threadlessly connectable to the atomizing sleeve 4. A preferred connection is a snap-in connection. For this purpose, the outlet region 12 has a disk-shaped end plate 15 at its end facing the inlet region 11, said end plate being designed so that it can sealingly engage into the peripheral groove 43 (FIG. 2) of the atomizing sleeve 4, in accordingly the same manner as was explained with reference to FIG. 2 for the elevated portion 24 of the mixer housing 2. An unwanted emergence of the atomizing medium during operation is efficiently avoided by this measure.

The connection between the outlet region 12 and the atomizing sleeve 4 via the end plate 15 and the peripheral groove 43 furthermore has the advantage that the atomizing sleeve 4 is rotatable about the direction of the axis B about the outlet region so that in operation the compressed air supply or the supply of the atomizing medium can take place from every lateral position.

The outlet region 12 furthermore has a central passage 16 for the mixed components which extends up to the outlet 14 and which has a substantially constant inner diameter. The outlet 14 of the connecting piece 1 is a model of the outlet opening 22 of the mixer housing 2 due to this measure. This measure also ensures that the flow-mechanical relationships at the outlet 14 of the connecting piece 1 are at least approximately the same, as if the atomizing sleeve is directly placed onto the mixer housing 2. No compromises in the quality of the spray process are consequently necessary due to the connecting piece 1.

In the operation of the combination of the connecting piece 1 with the spray mixer 100 (see FIG. 6), the atomizing medium, for example compressed air, is introduced through the inlet passage 41 into the atomizing sleeve 4, flows from there into the outlet region 12 of the connecting piece 1, where an unwanted backward emergence through the end plate 15 is prevented and moves along the outside of the passage 16 to the end section 13 in order there to flow into the separate flow passages which are formed by the grooves 5 in the atomizing sleeve and the end section 13 and through which the atomizing medium moves into the region of the outlet 14 where it atomizes the mixed components emerging there.

A further design measure is to provide at least one guide element 17 between the end plate 15 and the end section 13 of the outlet region 12, with the outer diameter of said guide element being modeled on the outer contour of the distal end region 27 of the mixer housing. It is meant by this that the guide element 17, which is a certain distance away—with respect to the direction fixed by the axis B—from the outlet 14 of the connecting piece 1, has substantially the same outer diameter as the mixer housing 2 at that point which is located at the same distance from the outlet opening 22 of the mixer housing. This measure can also positively contribute to the fact that the flow relationships for the atomizing medium introduced under pressure at the end of the connecting piece 1 are comparable or the same as those as they would be without the connecting piece 1 at the outlet opening 22 of the mixer housing 2.

In the embodiment in accordance with FIG. 3, exactly one guide element 17 is provided. This guide element 17 is designed in disk shape and has substantially the same outer diameter as the mixer housing 2 at that point which is the same distance away from the outlet opening 2 as the guide element 17 from the outlet 14 of the connecting piece 1.

Figure 4:
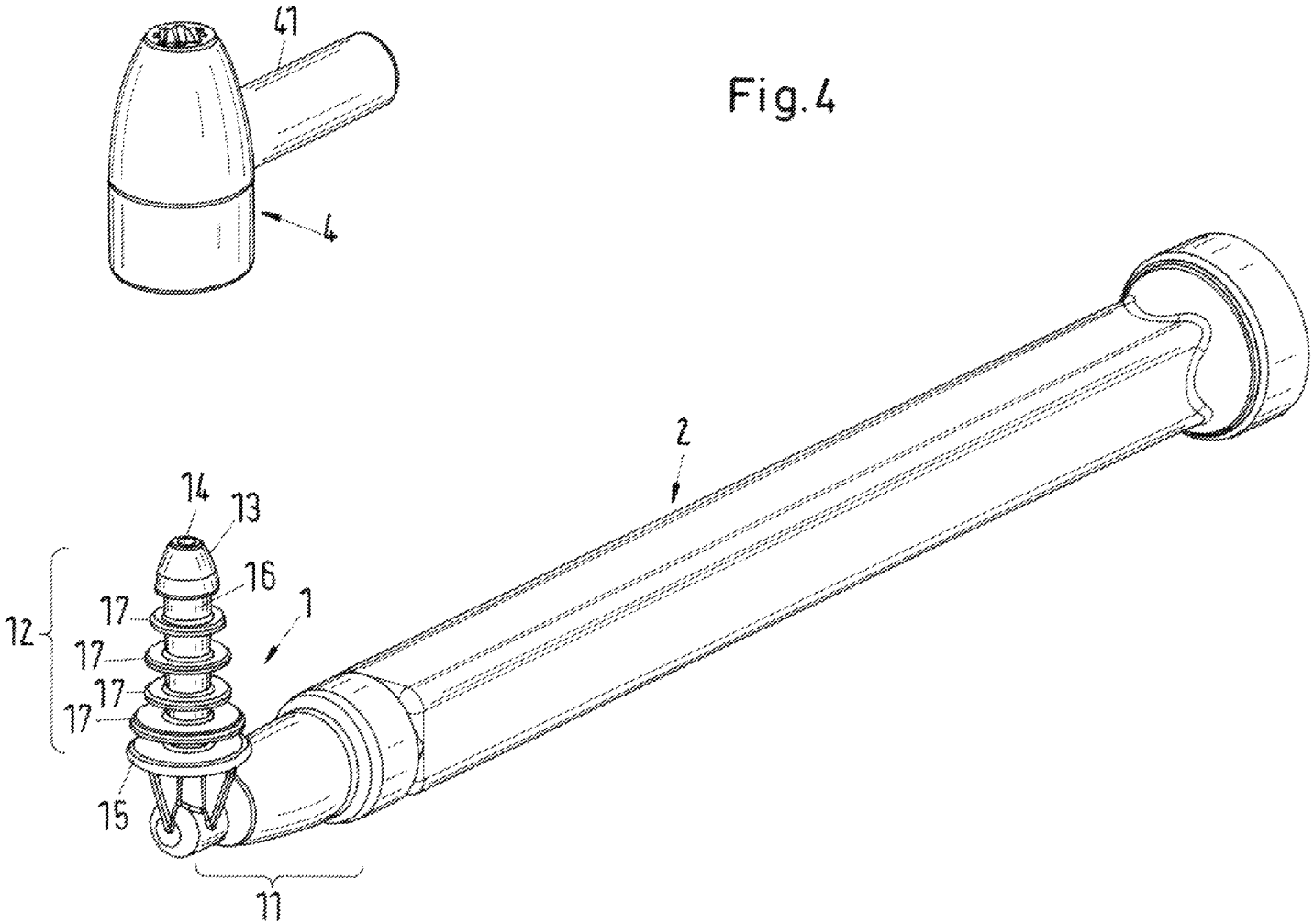
FIG. 4 is a perspective representation of another embodiment of a connecting piece in accordance with the invention placed onto the mixer housing of a static spray mixer.
Figure 5:
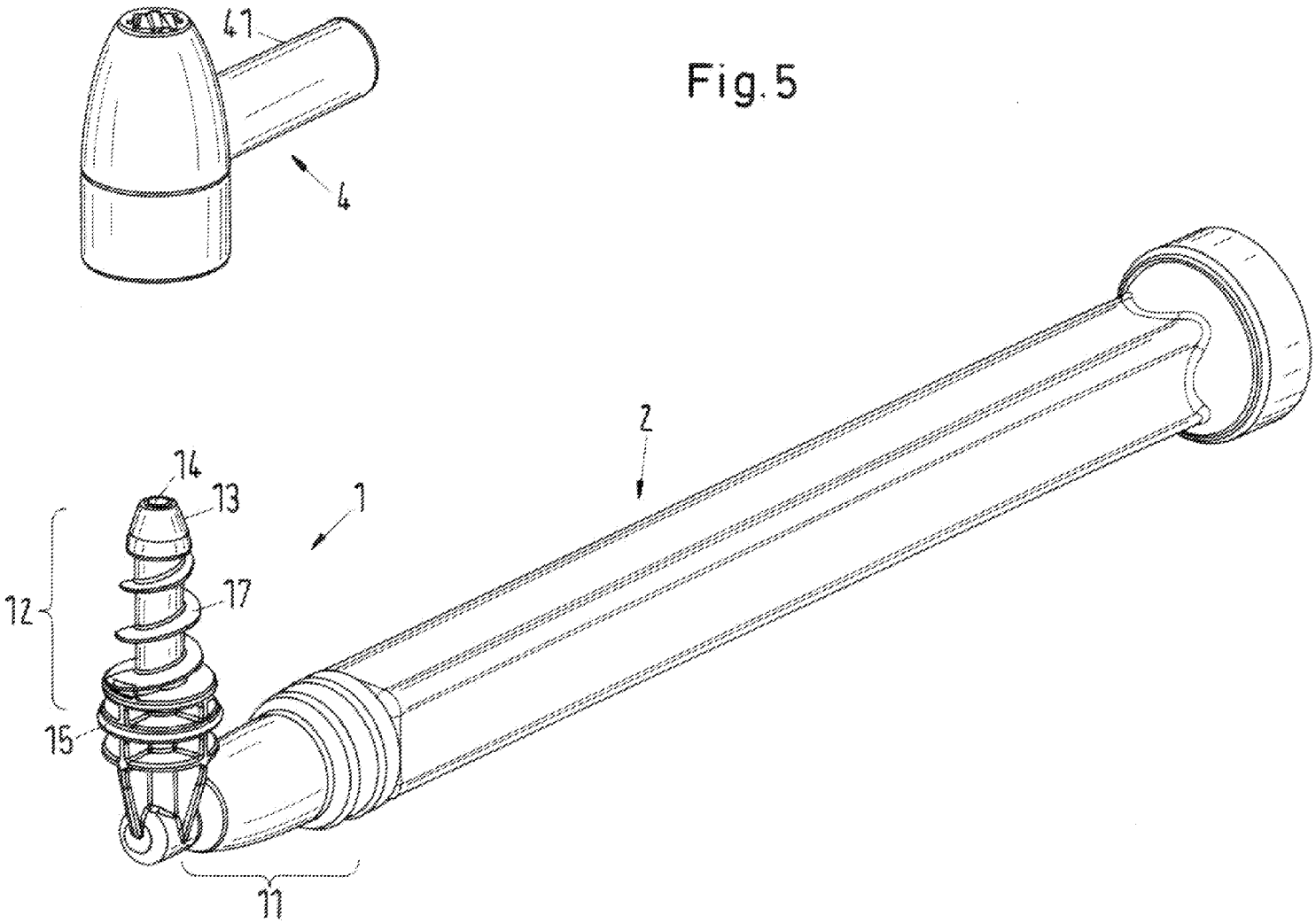
FIG. 5 is a perspective representation of a further embodiment of a connecting piece in accordance with the invention placed onto the mixer housing of a static spray mixer.

Another embodiment of the connecting piece 1 is shown in FIGS. 4 and 5 in a respective perspective illustration, with the connecting piece 1 being placed onto the mixer housing 2. In the following, only the differences from the embodiment shown in FIG. 3 will be explained; otherwise the explanations made in connection with the embodiment in FIG. 3 also apply in accordingly the same manner as to the embodiments in accordance with FIG. 4 and FIG. 5.

In the embodiment in accordance with FIG. 4, a plurality of respective disk-shaped guide elements 17, namely four, are provided arranged behind one another with respect to the direction fixed by the axis B. The outer diameter of the guide elements 17 is modeled on the outer diameter of the mixer housing 2.

In the embodiment in accordance with FIG. 5, a guide element 17 is provided which is designed as a helical guide element 17. The guide element 17 extends helically around the passage 17, with the outer diameter of the guide element being modeled on the outer diameter of the mixer housing.

FIG. 6 shows in a perspective representation a combination of a static spray mixer 100 with one of the embodiments of the connecting piece in accordance with the invention in the state assembled for operation.

It is also possible to configure the connecting piece 1 in accordance with the invention so that the deflection angle $\alpha$ is changeable, either in discrete steps or continuously. For this purpose, for example, an articulated connection, e.g. a hinge or a ball and socket joint, can be provided between the inlet region and the outlet region.

A further possibility for the combination in accordance with the invention is to shape the connecting piece 1 to the mixer housing 2 so that the connecting piece is in one piece with the mixer housing. The connecting piece 1 then forms the end of the mixer housing 2 which is angled by the deflection angle $\alpha$. that is, for example, by 90°—with respect to the longitudinal axis A of the mixer housing. From a technical manufacturing aspect, it is not a problem to realize such a one-piece embodiment. This is, for example, possible using injection molding processes.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A combination comprising:

a static spray mixer configured to mix and spray at least two flowable components, and including a tubular mixer housing having at least one mixing element, the mixer housing extending in a direction of a longitudinal axis up to a conical distal end of the mixer housing, the distal end having an outlet opening for the flowable components, and an atomizing sleeve having a conical receiving hole and an inlet passage for a pressurized atomizing medium and an inner surface having a plurality of separate grooves that are configured to form separate flow passages together with the mixer housing; and a connecting piece having a conical inlet region configured to detachably connect with the distal end region of the mixer housing, a conical outlet region being configured to detachably connect with the receiving hole of the atomizing sleeve at an internal region of the atomizing sleeve to receive the separate grooves that are configured to form the separate flow passages, and a deflection angle between the inlet region and the outlet region that is different from zero.

2. The combination in accordance with claim 1, wherein the deflection angle has a range of 45 to 135 degrees.

3. The combination in accordance with claim 2, wherein the deflection angle has a range of 60 degrees to 120 degrees.

4. The combination in accordance with claim 1, wherein the deflection angle is 90 degrees.

5. The combination in accordance with claim 1, wherein the inlet region contacts the distal end region of the mixer housing at an inner contour of the inlet region.

6. The combination in accordance with claim 1, wherein the inlet region of the connecting piece is threadlessly connectable to the mixer housing.

7. The combination in accordance with claim 1, wherein the outlet region of the connecting piece is threadlessly connectable to the atomizing sleeve.

8. The combination in accordance with claim 1, wherein the outlet region of the connecting piece has an end section facing an end plate of the inlet region, the end plate being configured to engage the atomizing sleeve to prevent an emergence of the atomizing medium from the end plate during operation.

9. The combination in accordance with claim 1, wherein the outlet region of the connecting piece includes a passage for the mixed components, the passage having a substantially constant inner diameter.

10. The combination in accordance with claim 8, further comprising at least one guide element having an outer diameter that is modeled on an outer contour of the distal end region of the mixer housing, the guide element being disposed between the end plate and the end section of the outlet region.

11. The combination in accordance with claim 10, wherein the at least one guide element comprises a plurality of respective disk-shaped guide elements arranged between the end plate and the end section of the outlet region, each of the disk-shaped guide elements having an outer diameter that is modeled on the outer diameter of the mixer housing.

12. The combination in accordance with claim 10, wherein the at least one guide element comprises a helical guide element having an outer diameter that is modeled on the outer diameter of the mixer housing.

13. The combination in accordance with claim 1, wherein the atomizing sleeve is rotatably connected to the connecting piece.

14. The combination in accordance with claim 1, wherein the connecting piece is integrally-formed with the mixer housing.

15. The combination in accordance with claim 1, wherein each of the plurality of separate grooves form a separate flow passage between an end of the outlet region of the connecting piece and the atomizing sleeve.

16. A combination comprising:

a static spray mixer configured to mix and spray at least two flowable components, and including a tubular mixer housing having at least one mixing element, the mixer housing extending in a direction of a longitudinal axis up to a distal end of the mixer housing, the distal end having an outlet opening for the flowable components, and an atomizing sleeve having a receiving hole and an inlet passage for a pressurized atomizing medium and an inner surface having a plurality of separate grooves that are configured to form separate flow passages together with the mixer housing;

a connecting piece having an inlet region configured to detachably connect with the distal end region of the mixer housing, an outlet region being configured to detachably connect with the receiving hole of the atomizing sleeve, and a deflection angle between the inlet region and the outlet region that is different from zero; and an articulated connection disposed between the inlet region and the outlet region, the articulated connection being one of a hinge and a ball and socket joint.

17. A combination comprising:

a static spray mixer configured to mix and spray at least two flowable components, and including a tubular mixer housing having at least one mixing element, the mixer housing extending in a direction of a longitudinal axis up to a conical distal end of the mixer housing, the distal end having an outlet opening for the flowable components, and an atomizing sleeve having a conical receiving hole and an inlet passage for a pressurized atomizing medium and an inner surface having a plurality of separate grooves that are configured to form separate flow passages together with the mixer housing; and a connecting piece having a conical inlet region configured to detachably connect with the distal end region of the mixer housing, a conical outlet region being configured to detachably connect with the receiving hole of the atomizing sleeve, the conical outlet region having a portion protruding from the atomizing sleeve when the atomizing sleeve is installed on the conical outlet region, and a deflection angle between the inlet region and the outlet region that is different from zero.

* * * * *